United States Patent [19]

Mitchell

[11] 3,989,013

[45] Nov. 2, 1976

[54] INTERNAL COMBUSTION ENGINE

[75] Inventor: Edward Mitchell, Hopewell Junction, N.Y.

[73] Assignee: Texaco Inc., New York, N.Y.

[22] Filed: June 12, 1974

[21] Appl. No.: 478,562

Related U.S. Application Data

[63] Continuation-in-part of Ser. No. 304,178, Nov. 6, 1972, abandoned.

[52] U.S. Cl. ..... 123/32 ST

[51] Int. Cl.[2] ..... F02B 17/00

[58] Field of Search ..... 123/32 ST, 119 B

[56] References Cited

UNITED STATES PATENTS

| | | | |
|---|---|---|---|
| 1,504,322 | 8/1927 | Brush | 123/32 ST |
| 2,400,247 | 5/1946 | Miller | 123/32 St |
| 2,484,009 | 10/1949 | Barber | 123/32 ST |
| 2,544,978 | 3/1951 | Blessing | 123/32 ST |
| 2,758,576 | 8/1956 | Schlamann | 123/32 ST |
| 2,803,230 | 8/1957 | Bensinger | 123/32 ST |
| 2,849,992 | 9/1958 | Stilleburoer | 123/32 ST |
| 3,315,650 | 4/1967 | Bishop | 123/32 ST |
| 3,408,992 | 11/1968 | Von Seggern | 123/32 ST |
| 3,439,656 | 4/1969 | Hideg | 123/32 ST |
| 3,621,825 | 7/1970 | Ojala | 123/119 B |
| 3,630,182 | 6/1970 | Grainger | 123/119 B |
| 3,696,798 | 10/1972 | Bishop | 123/32 ST |

*Primary Examiner*—Wendell E. Burns
*Assistant Examiner*—David D. Reynolds
*Attorney, Agent, or Firm*—T. H. Whaley; C. G. Ries; Robert B. Burns

[57] ABSTRACT

The invention relates to a method and apparatus for operating an internal combustion engine whereby to obtain maximum efficiency concomitant with minimum pollution of the atmosphere due to the discharge of exhaust gases. The engine is fueled with a stratified charge of a combustion supporting gaseous mixture, followed by the force injection of a fluidized fuel. To assure proper combustion, particularly at low loads, the intake volume of said combustion supporting medium is throttled. The conditions resulting within each combustion chamber are enrichment of the combustible charge and higher temperatures. As progressively greater loads are applied to the engine, the throttling action is progressively reduced to maintain a combustible, yet lean, mixture to midload. Further increase in load is accomplished by enrichment through increased fuel input.

4 Claims, 4 Drawing Figures

INTERNAL COMBUSTION ENGINE

This application is a continuation-in-part of application Ser. No. 304,178 filed Nov. 6, 1972, now abandoned.

BACKGROUND OF THE INVENTION

In the development of internal combustion type engines, the practice of controlling the charge and the subsequent ignition thereof, has afforded a highly efficient engine. Further, and toward minimizing the amount of harmful pollutants discharged into the atmosphere, means and systems have been provided to regulate both the exhaust gas quality as well as the condition of the intake flow.

One such engine adapted to operate in this improved manner, incorporates a system as disclosed in U.S. Pat. No. 2,484,009, issued in the name of Barber, and dated Oct. 11, 1949. Briefly the basic concept of this system and means of engine operation, resides in the close control of the fuel flow and the combustion supporting gas introduced to the engine, as well as the firing event. More specifically, said system provides that an internal combustion engine be so equipped to operate on a stratified charge which is periodically formed in an engine combustion chamber.

Thus, a combustion supporting gaseous medium such as air, or a modified mixture thereof, is introduced to an engine cylinder or combustion chamber. Said air charge is urged into the cylinder in such manner to assume a rapidly swirling path adjacent to the cylinder walls. The swirling combustion supporting stream is thereafter in the usual manner, compressed by an advancing piston head until the latter reaches top dead center position.

Immediately prior to said top dead center position, a predetermined volume of liquid fuel is forcibly injected into the cylinder by means of one or more injector nozzles. The injection is so controlled and directed as to form a liquid patch of limited area. A portion of the fringe of said patch, by virtue of its mixing with air, comprises a combustible medium or atmosphere. The latter occurs as a result of the peripheral mixing of the fuel patch moving at a high rate of speed with the combustion supporting gas.

The engine fuel injector nozzle as well as the igniter, are so arranged within the combustion chamber that the fuel patch will be ignited at a point closely adjacent to the igniter. Consequently, upon ignition the fuel patch will progressively mix with the combustion supporting gas until the patch is eventually consumed. At the termination of the resulting power stroke, exhaust gases are forced from the engine in the usual manner by way of an exhaust valve.

In the noted form of engine, control thereof in response to loading is achieved by varying the rate of fuel injection. Thus, normally with increased load, the intake volume of air per stroke is relatively constant, while the rate of fuel intake increases.

Inherently, this type of engine system embodies a number of advantages over the normal internal combustion engine which operates basically on an Otto cycle, using a relatively constant fuel/air ratio in the premixed charge. More specifically, the present engine as operated on a stratified charge, will provide not only a higher efficiency, but is capable of operating satisfactorily on varying grades of fuel with respect to both octane and cetane numbers.

One detriment however found to be present due to the nature of the air and fuel injection, results from an inherent characteristic of the engine and combustion system. For example, for virtually all engine operating conditions, there will be a varying fuel/air ratio of charge which is introduced into the combustion chamber. Thus, at relatively low loads the amount of fuel injected will lean the combustible charge defined by the mixture of said fuel with previously drawn-in air or combustion supporting gas. This leanness of the charge results in the engine running relatively cold such that the exhaust gases will contain a considerable amount of undesirable air polluting materials when such gases are discharged directly into the atmosphere. Further, reaction of said "cold" gases with a catalytic filter or the like will be minimized or dampened since the catalyst will be caused to operate at a lower temperature.

Toward overcoming these inherent disadvantages in the operation of an internal combustion engine there is presently provided a method of operating such an engine, as well as the apparatus therefor. In accordance with the disclosed method, a stratified charge including discrete injections of air and fuel, are separately introduced to the engine combustion chamber. The air is rapidly rotated within the chamber as the piston head advances toward the top position on the compression stroke.

Prior to the cylinder reaching the top dead center position a pressurized fuel stream is introduced to the combustion chamber to form a limited area patch of fuel in the circulating air. The fringes of the fuel patch contact the rapidly moving swirling air to form said fringe areas into a combustible mixture. The latter is then ignited by the ignition means to initiate the power stroke.

At low loads the overall fuel mixture charge is in effect enriched through the step of throttling the air stream. Ignition of the combustible mixture is thereby more readily facilitated such that the latter burns at a higher temperature and thus minimize undesirable emissions in the exhaust stream.

Thereafter as engine load is progressively increased, the throttling step is progressively reduced until at optimum conditions of load, throttling is completely discontinued.

Figure 1:
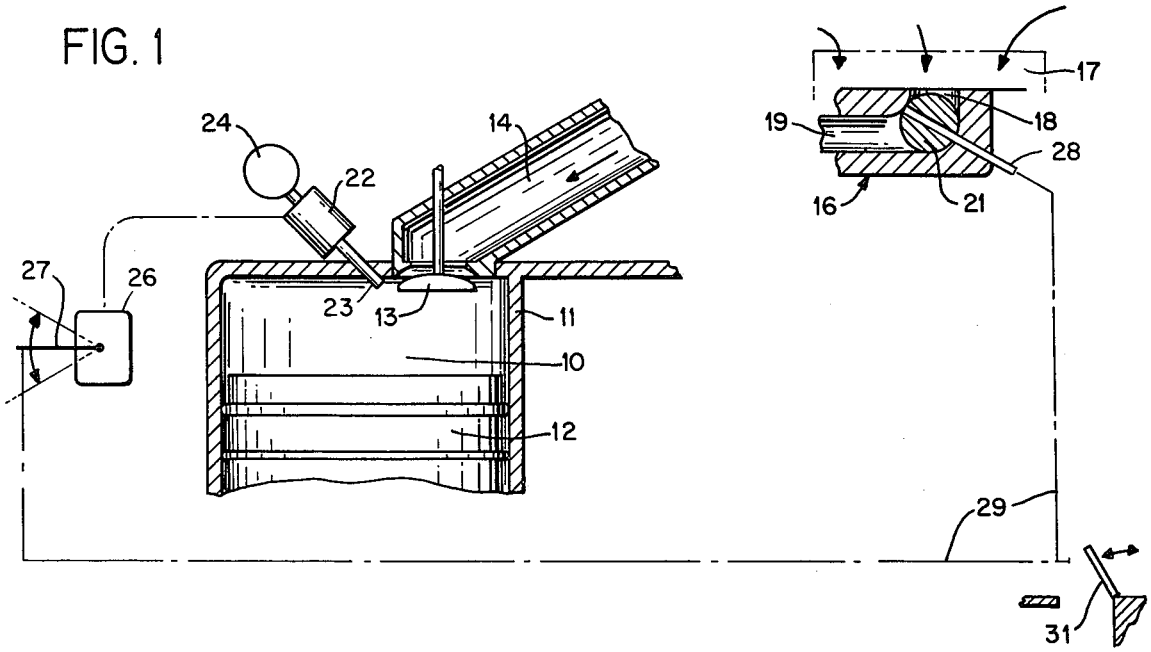
FIG. 1 illustrates diagrammatically a cross sectional view of one cylinder including the combustion chamber of an internal combustion engine in which fuel and air are separately introduced.
Figure 2:
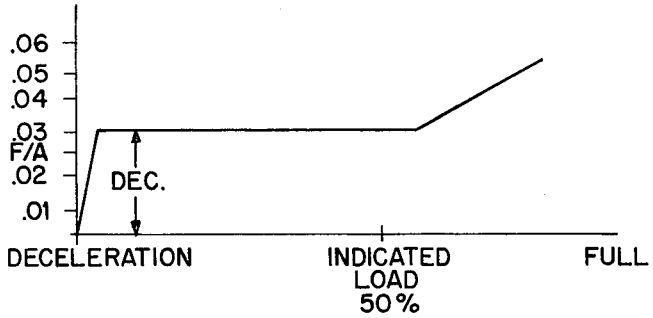
FIGS. 2, 3 and 4 illustrate graphically the relationship existing between indicated load on an engine, fuel/air ratio, air rate, and intake manifold vacuum respectively.
Figure 3:
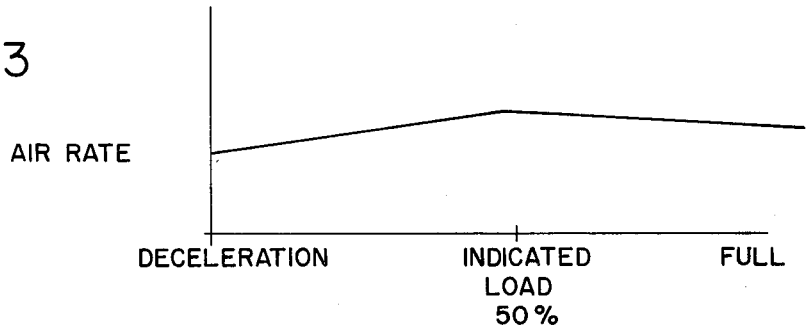
Figure 4:
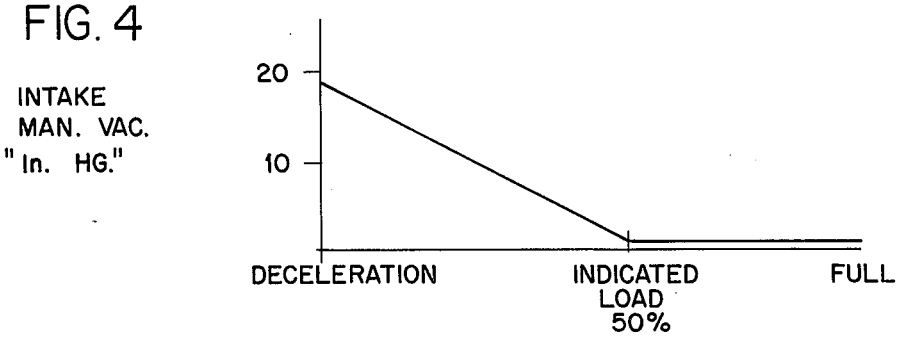

In the following description the combustion supporting medium will be considered to be air although a suitable mixture of air, and one or more other gases could be appropriately applied to the instant process. The engine igniter or ignition means herein described includes the normally operated spark plug which is positioned within the combustion chamber to be periodically ignited through a timed ignition system. Fuel injected into the engine combustion chamber is normally in the liquid phase in droplet form, although a gaseous fuel could as well be utilized.

Referring to the drawings, although a simple combustion chamber 10 is here illustrated, it is understood that an internal combustion engine is normally made up of a plurality of such chambers appropriately arranged with individual manifolding to receive the desired flow of combustion supporting medium. Each cylinder 11 is provided with a reciprocably acting piston 12 which in a normal manner is connected to a common drive shaft or similar means not shown.

Said combustion chamber 10 within cylinder 11 is provided in the instance of the present arrangement with intake valve 13 and one or more exhaust valves. While not presently shown, in the instance of a two cycle engine either or both ports may be positioned at a lower lever in the cylinder rather than at the top whereby to admit or release gases as the piston moves past and exposes said ports.

In the instant arrangement, intake valve 13 is communicated through a manifold or conduit means 14 to an air controller or source 16. The latter comprises an air filter 17 having an open end to receive a flow of atmospheric air which enters an internal chamber 18. The latter is provided with a cylindrical shaped flow passage 19. Said passage 19 is further provided with an externally actuated flapper valve 21. The latter in accordance with normal throttle structure, is pivotally mounted and rotatably actuated through its various positions whereby to vary air flow drawn through passage 19. Air will thus enter intake valve 13 in response to a reduced pressure within the combustion chamber 10.

Introduction of fuel to the combustion chamber 10 is achieved through a fuel injector 22 having a nozzle 23 which extends into said chamber. Injector 22 is operably connected through a suitable mechanism or linkage to a cam 24 or the like for periodically actuating the injector. The latter thereby provides a timed, desired volume of fuel to the engine combustion chamber.

Said injector 22 is communicated with a source of fuel 26, normally a fuel pump which is individually communicated with an injector at each combustion chamber. Pump 26 can be manually or electrically operated and timed with the engine ignition to provide the desired fuel injection in the proper order and volume or amount.

Toward providing the desired engine control, said fuel pump 26 includes an external actuating arm 27. In a similar manner, flapper valve 21 is provided with an external arm or actuating means 28. Each of said arms 27 and 28 is mutually connected through linkage 29 to a control lever herein shown as foot pedal 31 of a vehicle or the like.

Thus, in response to actuation of the said foot pedal 31, there will be a simultaneous actuation of fuel pump 26 as well as of the flapper valve 21. The latter of course serves to regulate the amount or volume of air drawn into combustion chamber 10 at each piston stroke in response to the depressed pressure created by the intake stroke of piston 12.

Under normal conditions, air flow through said passage 19 will be dependent entirely on the pressure drop created within combustion chamber 10. As presently shown however said air flow is contingent also on the position of flapper 21 relative to passage 19.

Operationally, in the form of internal combustion engine presently alluded to the volume of combustion supporting air drawn into chamber 10, is relatively constant across the entire load range of the engine.

However, as engine load increases, the amount of fuel injected therein will increase commensurably such that the overall fuel to air ratio will gradually increase proportionally to the engine load. As previously mentioned, it has been found that for the lower range of engine loads, the degree of fuel injection will be such that the resulting ratio is quite lean, a condition that results in lower cylinder temperature and consequently in a higher output of hydrocarbon (HC) in the exhaust gases.

To overcome this propensity for the engine to run under overly lean conditions, linkage 29 interconnecting the respective fuel pump 26 and air regulator 16 is so adapted that at said lower loads the amount of air which is introduced is throttled to a point that the normally very lean fuel to air mixture is enriched a desired amount. Said air throttling is decreased as engine loading is progressed from approximately zero to one half indicated load. The degree of air throttling with changing load is decreased progressively until such action is completely discontinued. Thereafter, for further loading of the engine the amount of fuel injected into each cylinder will be increased slightly with each cycle to increase the fuel to air ratio a commensurable amount.

As a result of this increase in the charge richness at lower loads, there will be a consequent increased temperature within combustion chamber 10. Thus, the flow of exhaust gases from said chamber will be at relatively higher temperatures. These exhaust gases are then in a more amenable condition to be treated within a catalytic or exhaust reactor. This follows since the effectiveness of gas treatment within a catalytic reactor is normally a function of the temperature at which the catalytic member contacts exhaust gases. Additionally, the emissions emitted by the engine to the exhaust reactor have been shown to be reduced by this increased charge richness.

It is further noted that in accordance with the present method of inlet air throttling at a point of operation when a vehicle is moving under decelerating conditions or down hill the indicated load will be zero with fuel being cut off and only a throttled charge of the combustion supporting gaseous medium will be present in the combustion chamber. Therefore, no harmful pollutants will be emitted to the atmosphere under these conditions.

It is further noted that the presently described engine throttling operation functions regardless of the composition of the combustion supporting medium. Said medium can for example comprise essentially air, which is modified by an additional gas such as engine exhaust gas that is recycled to be combusted.

Other modifications and variations of the invention as hereinbefore set forth may be made without departing from the spirit and scope thereof, and therefore, only such limitations should be imposed as are indicated in the appended claims.

I claim:

1. Method for controlling an internal combustion engine operation through the operating range thereof, to reduce the amount of harmful pollutants formed thereby and discharged into the atmosphere said engine having at least one combustion chamber in which a power element is actuated, and into which chamber a stratified charge is delivered, said charge comprising; a combustion supporting mixture which is initially introduced into said combustion chamber to be guided into a swirling path about said chamber, and a measured quantity of fuel which is injected into the swirling combustion supporting mixture in a manner to form a localized fuel patch, a limited segment of the latter being combined with the combustion supporting mixture to form a combustible segment of the charge which is ignited to initiate the engine power stroke, the improvement for operating said engine during the operating range between idle and approximately 50 percent of full load, which includes the steps of;

a. throttling the amount of combustion supporting mixture which is introduced to said combustion chamber whereby to form a rich fuel/combustion supporting mixture ratio therein at idle operation, and progressively decreasing the degree of throttling to form a more lean mixture as the engine load is increased from idle to approximately one-half full load.

2. In a method as defined in claim 1, wherein said combustion supporting mixture is primarily air, and the fuel/combustion supporting mixture ratio is fuel/air.

3. In a method as defined in claim 1, wherein said combustion supporting mixture comprises a major portion of air, and a minor portion of exhaust gas.

4. In a method as defined in claim 3, wherein said exhaust gas results from the combustion step in said engine combustion chamber, which gas is recycled to said chamber to intermix with air.

* * * * *